US011396784B2

(12) United States Patent
Szpunar et al.

(10) Patent No.: US 11,396,784 B2
(45) Date of Patent: Jul. 26, 2022

(54) SUBSEA TEST TREE ASSEMBLY

(71) Applicant: Expro North Sea Limited, Aberdeenshire (GB)

(72) Inventors: Dariusz Szpunar, Aberdeen (GB); Paul Deacon, Aberdeen (GB); Jamie Walker, Kintore (GB)

(73) Assignee: Expro North Sea Limited, Dyce (GB)

( * ) Notice: Subject to any disclaimer, the term of this patent is extended or adjusted under 35 U.S.C. 154(b) by 0 days.

(21) Appl. No.: 17/266,726

(22) PCT Filed: Aug. 6, 2019

(86) PCT No.: PCT/GB2019/052196

§ 371 (c)(1),
(2) Date: Feb. 8, 2021

(87) PCT Pub. No.: WO2020/030897

PCT Pub. Date: Feb. 13, 2020

(65) Prior Publication Data

US 2021/0310327 A1 Oct. 7, 2021

(30) Foreign Application Priority Data

Aug. 8, 2018 (GB) ..... 1812902

(51) Int. Cl.

| | |
|---|---|
| ***E21B 34/04*** | (2006.01) |
| ***E21B 33/035*** | (2006.01) |
| ***E21B 33/06*** | (2006.01) |
| *E21B 33/064* | (2006.01) |

(52) U.S. Cl.
CPC ..... *E21B 33/0355* (2013.01); *E21B 33/063* (2013.01); *E21B 34/04* (2013.01); *E21B 33/064* (2013.01); *E21B 2200/04* (2020.05)

(58) Field of Classification Search
CPC .. E21B 33/0355; E21B 33/063; E21B 33/064; E21B 34/04; E21B 2200/04
See application file for complete search history.

(56) References Cited

U.S. PATENT DOCUMENTS

| | | | | |
|---|---|---|---|---|
| 3,870,101 A * | 3/1975 | Helmus | E21B 49/001 166/363 |
| 4,325,409 A * | 4/1982 | Roberts | E21B 33/0355 137/596.14 |
| 4,378,850 A * | 4/1983 | Barrington | E21B 34/045 166/373 |
| 10,683,721 B2 * | 6/2020 | Cowie | E21B 34/045 |
| 2008/0110633 A1 * | 5/2008 | Trewhella | E21B 33/04 166/336 |

(Continued)

*Primary Examiner* — Aaron L Lembo
(74) *Attorney, Agent, or Firm* — Getz Balich LLC

(57) ABSTRACT

A subsea test tree assembly is provided which includes at least one subsea test tree or SSTT, the SSTT including a valve having at least one of a cutting function and a sealing function, the valve being movable between an open position and a closed position via hydraulic fluid supplied to the valve through control lines; and a control system including a source of hydraulic fluid, the control system being arranged to supply hydraulic fluid from the source of hydraulic fluid to the valve of the at least one SSTT on detecting that the control lines have been sheared, to automatically move the valve to the closed position. A method of controlling a well using an SSTT assembly is also provided.

29 Claims, 7 Drawing Sheets

(56) References Cited

U.S. PATENT DOCUMENTS

| | | | | |
|---|---|---|---|---|
| 2015/0192431 | A1* | 7/2015 | Jonsjord | G01D 5/14<br>324/207.11 |
| 2017/0152723 | A1 | 6/2017 | Deacon | |
| 2017/0370170 | A1* | 12/2017 | Rytlewski | E21B 29/08 |

* cited by examiner

SUBSEA TEST TREE ASSEMBLY

This application claims priority to PCT Patent Appln. No. PCT/GB2019/052196 filed Aug. 6, 2019, which claims priority GB Patent Appln. No. 1812902.3 filed Aug. 8, 2018, which are herein incorporated by reference.

BACKGROUND OF THE INVENTION

1. Technical Field

The present invention relates to a subsea test tree assembly. In particular, but not exclusively, the present invention relates to a subsea test tree assembly comprising at least one subsea test tree (SSTT), the SSTT comprising a valve having at least one of a cutting and a sealing function, the valve being movable between an open position and a closed position via hydraulic fluid supplied to the valve through control lines. The invention also relates to a method of controlling a well using an SSTT assembly.

2. Background Information

In the oil and gas exploration and production industry, wellbore fluids comprising oil and/or gas are recovered to surface through a wellbore which is drilled from surface. The wellbore is lined with metal wellbore-lining tubing, which is known in the industry as casing. The casing is cemented in place within the drilled wellbore, and serves numerous purposes including: supporting drilled rock formations; preventing undesired ingress/egress of fluid; and providing a pathway through which further tubing and downhole tools can pass.

Numerous tubing strings and tools are run-in to the well during a procedure to complete the well in preparation for production, as well as during subsequent production of well fluids, and any intervention procedures which may need to be carried out during the lifetime of the well. For example, well fluids are recovered through production tubing which is installed within the cased well, extending from the surface to the region of a producing formation. Tool strings can be run-into the well, carrying downhole tools for performing particular functions within the well. Coiled tubing and wireline or slickline can be employed as an efficient method of running a downhole tool into a well.

Safety legislation requires the provision of a blow-out preventer (BOP), comprising an arrangement of shear and seal rams, which provides ultimate pressure control of the well. In an emergency situation, seal rams can seal around tubing extending through the BOP, to seal an annulus around the tubing. If required, shear rams can be activated to sever tubing and/or wireline extending through the BOP, to shut-in in the well. Other valve assemblies are provided as part of tubing strings that are run-into and located within the well. Examples include subsurface safety valves (SSSVs), which are typically installed in an upper part of the wellbore, and subsea test trees (SSTTs), which are typically installed in a lower part of the wellbore. SSSVs and SSTTs provide emergency closure of producing conduits in the event of an emergency situation arising. It is generally preferable to use the SSTTs to close the producing conduits, rather than the BOP. In particular, it is desirable to avoid actuating the BOP shear rams, if possible.

SSSVs and SSTTs comprise an arrangement of valves which are required to perform a cutting and/or sealing function. This is to ensure safe cutting of tubing (such as coiled tubing) or other equipment extending through the valves, and subsequent sealing of the SSSV/SSTT bore. Numerous different types of valves can be used, but ball-type valves are often preferred. Ball-type valves comprise a ball member which is rotatable between an open position in which a bore of the ball member is aligned with a bore of a housing in which the ball member is mounted, and a closed position in which the bore of the ball member is disposed transverse to the housing bore, thereby closing the valve. Ball-type valves can have a cutting function (to sever tubing or other equipment extending through the bore of the ball), a sealing function, or a cutting and sealing function.

Typically, upper and lower SSTTs will be provided, and are run-into the well on a string of tubing extending to surface. Often, one of the SSTTs will have a cutting function and the other a sealing function. The SSTTs are located within the BOP, and are suspended from the casing in the wellbore using a tubing hanger, which is located downhole of the BOP. A latch connects the upper SSTT to the tubing string. A shear sub is provided between the latch and the string, and located so that it extends across the shear rams of the BOP. An integral slick joint (ISJ) is typically provided between the upper and lower SSTT, and located so that it extends across seal rams of the BOP. In the event of an emergency situation arising, the well may require to be shutdown. In extreme situations, this may require actuation of the BOP shear rams to sever the shear sub, and/or the seal rams to seal an annulus surrounding the ISJ.

There are typically three shutdown levels: a process shutdown (PSD) in which a surface flow tree is closed to isolate the well at surface; an emergency shutdown (ESD), in which upper and lower SSTT valves are closed, isolating the well downhole; and an emergency quick disconnect (EQD), in which the upper and lower SSTT valves are closed and the BOP shear and seal rams actuated. Ideally, in the case of an EQD, there will be sufficient time to activate the SSTT valves, and to then release the latch and recover the tubing string to surface, prior to actuation of the BOP shear and seal rams. However, in an extreme situation, it may be necessary to operate the BOP shear rams prior to release of the tubing string, the rams then severing the shear sub so that the tubing string can be recovered.

In an intervention procedure, downhole tools may be run into the well on coiled tubing, wireline or slickline which extends through the BOP and the arrangement of valves located in the wellbore. If an EQD is required during an intervention procedure, the presence of tubing or other equipment in the bore of the SSTT valves can complicate the shutdown procedure. In particular, it will be necessary to first recover the tubing (or other equipment) to surface, or to sever the tubing within the wellbore, using the valve of the SSTT which has the cutting function (typically the upper SSTT).

The SSTT valves are actuated using hydraulic fluid, supplied from surface via control lines coupled to the SSTT. The SSTT valves failsafe to their closed positions, via a spring coupled to the valve. In the event of a loss of hydraulic control occurring, the spring acts to move the valve to its closed position. However, significant force is required to operate the cutting valve, to sever tubing (or other equipment) located in the valve bore. The spring force is not sufficient to sever such tubing. Accordingly, significant hydraulic pressure force is applied to the valve, via the control lines, to urge the valve to its closed position, severing the tubing (or other equipment) located in the valve bore.

A problem can therefore occur when the BOP shear rams are actuated. This is because actuation of the BOP shear rams severs the control lines, isolating the SSTT valves from their supply of hydraulic control fluid. If the BOP shear rams are actuated prior to the SSTT valves, then this has the result that the bore of the SSTT cutting valve can be blocked by the tubing (or other equipment) being used in the intervention procedure. The valve bore would then remain open, pressure control then being provided solely by the BOP. This removes a required level of redundancy in the system.

This is exacerbated in current equipment, in which control systems for the BOP and the SSTTs are not connected, and which can lead to an incorrect shutdown procedure. Furthermore, there is a potential for the latch that couples the tubing string to the SSTTs to be located across the BOP shear rams, particularly where the latch has been operated and the tubing released from the SSTTs. The BOP shear rams are not capable of shearing the latch, which has the result that the BOP rams become blocked (the BOP being held open by the latch). Pressure control would then be lost and a shutdown could not be achieved.

SUMMARY OF THE INVENTION

According to a first aspect of the present invention, there is provided a subsea test tree assembly comprising: at least one subsea test tree (SSTT), the SSTT comprising a valve having at least one of a cutting function and a sealing function, the valve being movable between an open position and a closed position via hydraulic fluid supplied to the valve through control lines; and a control system comprising a source of hydraulic fluid, the control system being arranged to supply hydraulic fluid from the source of hydraulic fluid to the valve of the at least one SSTT on detecting that the control lines have been sheared, to automatically move the valve to the closed position.

The present invention provides the advantage that the SSTT valve can be actuated even following shearing of the control lines which are normally used to actuate the valve and so control the operation of the at least one SSTT. The SSTT will therefore failsafe to a closed state in the event that the control lines become sheared. This addresses the problem of BOP shear rams shearing control lines coupled to an SSTT, preventing actuation of the SSTT valve.

Reference is made in this document to control lines being sheared. It will be understood that shearing of the control lines will occur on actuation of a BOP shear ram. This will typically involve the control lines being completely severed, closing off fluid communication between a source of hydraulic control fluid (typically a pump provided at surface) and the SSTT. However, it will be understood that damage to the control lines may occur which does not result in complete severing of the control lines, but which results in fluid leakage and so prevents the effective supply of hydraulic control fluid to the SSTT. The reference to the control lines being sheared should be interpreted accordingly.

Reference is made in this document to a valve having a cutting function. It will be understood that a valve having a cutting function is one which is capable of cutting (and so severing) tubing, wireline, slickline or other equipment passing through the SSTT, and so through the valve. Reference is also made to a valve having a sealing function. It will be understood that a valve having a sealing function is one which is capable of sealing a bore of an SSTT to prevent fluid flow along the bore past the valve.

The control system may be arranged to detect that the SSTT valve is in its open position, and to close the valve on subsequently detecting that the control lines have been sheared.

It may be preferred that the SSTT valve have a cutting function. The SSTT valve may have a sealing function. The SSTT valve may have both a cutting and a sealing function.

The SSTT may be a first SSTT, and may be an upper SSTT. The assembly may comprise at least one further SSTT, which may be a second SSTT, and may be a lower SSTT. The at least one further SSTT may comprise a valve, the valve being movable between an open position and a closed position via hydraulic fluid supplied to the valve through control lines. One of the first and at least one further SSTT may comprise the valve having the cutting function. The other one of the first and at least one further SSTT may comprise a valve having a sealing function. At least one of the SSTTs may comprise a valve having a cutting and a sealing function. Typically, the SSTT which is to be located uppermost in the well (i.e. closer to surface) will comprise the valve having the cutting function. However, it is conceivable that the SSTT which is located lowermost in the well (i.e. further from the surface) have the cutting function, for example if operation of the SSTT assembly is effected with a delay relative to operation of BOP shear rams, the shear rams serving to sever the tubing etc. which may then fall through the SSTT assembly. The or each SSTT may comprise more than one valve, the function of a further valve or valves being selected from: a cutting function; a sealing function; and a cutting and sealing function.

Reference is made in this document to an upper SSTT and a lower SSTT. It will be understood that this does not necessarily imply a particular orientation of the SSTTs. The upper SSTT will typically be located closer to the surface than the lower SSTT, and the terms should be interpreted accordingly.

The valve may be a ball-type valve comprising a ball member which is rotatable between: the open position, in which a bore of the ball member is aligned with a bore of a housing of the SSTT in which the ball member is mounted; and a closed position, in which the bore of the ball member is disposed transverse to the housing bore, thereby closing the valve. Where the ball-type valve has a cutting function, the ball member may comprise a cutting surface or edge.

The control system may be arranged to move the valve of the at least one further SSTT to its closed position on detecting that the control lines have been sheared, to automatically move the valve to the closed position. The control system may be arranged to move the valve of the at least one further SSTT to the closed position with a time delay over or relative to the movement of the valve of the first SSTT to its closed position. Where the valve of the first SSTT has a cutting function, this may provide the advantage that tubing, wireline, slickline or other equipment located within a bore of the valve of the at least one further SSTT may be cut (or severed) prior to actuation of said valve. This may prevent a bore of the valve of the at least one further SSTT being blocked, as the cut tubing, line or other equipment will typically fall through the bore of the valve prior to it being closed.

The control system may comprise a pilot (or trigger) line, which may be separate to the control lines of the at least one valve. Shearing of the pilot line may trigger movement of the valve to the closed position. The pilot line may be coupled to the source of hydraulic fluid, for supplying hydraulic fluid to the source from surface, and/or for pressurizing the hydraulic fluid from surface (prior to shearing of the pilot line). It will be understood that shearing of the pilot line does not prevent the hydraulic source from supplying fluid to operate the valve to move to its closed position.

The valve of the at least one SSTT may be a first valve. The assembly may comprise at least one further valve which is movable between an open position and a closed position via hydraulic fluid supplied to the further valve through control lines, and which may be a second valve. The SSTT may comprise the at least one further valve, or the assembly may comprise at least one further SSTT comprising the further valve. One of the first and further valves may have a cutting function. The other of the first and further valves may have a sealing function. The first valve may be an upper valve. The further valve may be a lower valve. The control system may be arranged to move the further valve to its closed position on detecting that the control lines have been sheared, to automatically move the further valve to the closed position. The control system may be arranged to move the further valve to the closed position with a time delay over or relative to the movement of the first valve to its closed position. Where the assembly comprises a plurality of SSTTs, at least one of the SSTTs may comprise a first valve and at least one further valve.

The time delay may be effected by suitable logic programmed into a processor of the control system. The processor may control a solenoid that maintains the valve in the first position for a determined period of time.

Control lines may be coupled to the or each valve to control movement of the valve between the open and closed positions. The or each valve may be mechanically biased towards its closed position, for example by a spring, which may be a compression spring. Where there are a plurality of SSTTs, separate control lines may be provided for each SSTT. Where there are a plurality of valves (in one or separate SSTTs), separate control lines may be provided for each valve.

The subsea test tree assembly may comprise the control lines. Alternatively, the control lines may be provided separately from the assembly.

The source of hydraulic fluid may comprise or take the form of a hydraulic accumulator. This may facilitate the storage of hydraulic energy for actuation of the valve of the at least one SSTT in the event that the control lines are sheared. The hydraulic accumulator may comprise a hydraulic fluid storage chamber, and an accumulation fluid storage chamber. The accumulation fluid may be a gas, such as Nitrogen or Helium. The hydraulic accumulator may comprise a pressurizing element such as a piston, diaphragm or the like separating the hydraulic fluid storage chamber from the accumulation fluid storage chamber, hydraulic energy being stored by compression of the accumulation fluid. The accumulator may be charged with hydraulic fluid from surface via a hydraulic line. The hydraulic line may comprise a one-way valve to restrict fluid flow back along the line in the event that the line is sheared, for example by BOP shear rams.

The control system may comprise a control valve for controlling the flow of hydraulic fluid to the valve of the at least one SSTT. The control valve may be arranged so that it detects that the control lines have been sheared, for example by detecting a loss of pressure in the control lines. The control valve may be a first control valve. The control valve may be coupled to the control lines, for receiving hydraulic fluid, and may control the flow of the fluid to and from the valve of the SSTT. The SSTT valve may be hydraulically operated. The SSTT valve may comprise a piston which is movable under applied fluid pressure, and a valve member associated with the piston and which is movable between a closed position where it closes (or at least restricts) a bore of the SSTT and an open position in which the bore is open (or at least less restricted than in the closed position). The piston may be mounted for movement within a cylinder, fluid being supplied to the cylinder by the control valve. The control valve may be adapted to create a pressure differential across the piston to move the piston in a desired direction. The control valve may control the flow of fluid to and from a first chamber at a first end of the cylinder, and a second chamber at a second end of the cylinder, to control movement of the piston. The first chamber may be a valve opening chamber, fluid supplied into the opening chamber serving to open the SSTT valve. The second chamber may be a valve closing chamber, fluid supplied into the closing chamber serving to close the SSTT valve.

The control system may be arranged to actuate the control valve on detecting that the control lines have been sheared, to move the control valve from a first position in which the SSTT valve is in communication with the control lines, to a second position in which the SSTT valve is out of communication with the control lines. This may serve to isolate the SSTT valve from the control lines when the lines are sheared, which may isolate the SSTT valve from fluid in the wellbore that could otherwise be communicated to the SSTT valve. In the second position, the control valve may place the first and second ends of the cylinder (in particular the first and second chambers) in fluid communication, to permit movement of the piston to operate the SSTT valve. The SSTT valve, in particular the piston, may be biased in a direction which urges fluid from one of the first and second ends of the cylinder to the other one of the first and second ends. The piston may be biased in a direction which moves the valve member towards its closed position. Movement of the control valve to its second position may cause the SSTT valve to close on tubing or other equipment extending through the SSTT valve.

The control system may comprise a control valve associated with the source of hydraulic fluid. The control valve may be a second control valve. The control valve may be coupled to the source of hydraulic fluid and to the valve of the SSTT. The control valve may be arranged to control the flow of fluid from the hydraulic fluid source to the SSTT valve in the event that the control lines are sheared. The control valve may be movable between a first position where the hydraulic fluid source is out of communication with the SSTT valve, and a second position where the hydraulic fluid source is in communication with the SSTT valve. Where there are first and second control valves, the control system may be arranged to operate the second control valve to move to its second position only after movement of the first control valve to its second position. In this way, hydraulic fluid is only supplied from the fluid source in the event that the control lines are sheared. The hydraulic fluid supplied from the fluid source to the SSTT valve may act to urge the SSTT valve to its closed position. Where the valve has a cutting function, this may cut or sever tubing or other equipment extending through the SSTT valve, in particular through a bore of a valve member of the valve.

The control system may comprise a vent chamber which communicates with the valve of the SSTT so that it receives hydraulic fluid from the valve when it is moved to its closed position. When the second control valve is in its second position, one of the first and second ends of the SSTT valve cylinder may communicate with the vent chamber. The valve opening chamber of the cylinder may communicate with the vent chamber. The vent chamber may contain a fluid (suitably a gas) at a lower pressure than the fluid in the cylinder, so that the fluid in the cylinder can be vented to the vent chamber. This may facilitate movement of the SSTT valve to its closed position.

The control system may comprise a hydraulic accumulator which communicates with the valve of the SSTT so that it receives hydraulic fluid from the valve when it is moved to its closed position. The hydraulic accumulator may comprise a hydraulic fluid storage chamber, and an accumulation fluid storage chamber. The accumulation fluid may be a gas, such as Nitrogen or Helium. The hydraulic accumulator may comprise a pressurizing element such as a piston, diaphragm or the like separating the hydraulic fluid storage chamber from the accumulation fluid storage chamber, hydraulic energy being stored by compression of the accumulation fluid. When the second control valve is in its second position, one of the first and second ends of the SSTT valve cylinder may communicate with the hydraulic accumulator.

The second control valve may be associated with the first control valve. Fluid may flow from the first end of the SSTT valve cylinder (in particular the opening chamber), through the first control valve to the second control valve, and through the second control valve to the second end of the cylinder (in particular the closing chamber).

Where the assembly comprises a second SSTT, the control system may comprise a separate control valve for controlling the flow of hydraulic fluid to the valve of the second SSTT. The control valve may be coupled to control lines (which may be separate control lines from those associated with the first SSTT) for receiving hydraulic fluid, and may control the flow of the fluid to and from the valve of the second SSTT. The second SSTT valve may be hydraulically operated. The second SSTT valve may comprise a piston which is movable under applied fluid pressure, and a valve member associated with the piston and which is movable between a closed position where it closes (or at least restricts) a bore of the second SSTT and an open position in which the bore is open (or at least less restricted than in the closed position). The piston may be mounted for movement within a cylinder, fluid being supplied to the cylinder by the control valve. The control valve may be adapted to create a pressure differential across the piston to move the piston in a desired direction. The control valve may control the flow of fluid to and from a first chamber at a first end of the cylinder, and a second chamber at a second end of the cylinder, to control movement of the piston. The first chamber may be a valve opening chamber, fluid supplied into the opening chamber serving to open the second SSTT valve. The second chamber may be a valve closing chamber, fluid supplied into the closing chamber serving to close the second SSTT valve.

The control system may be arranged to actuate the control valve of the second SSTT on detecting that the control lines have been sheared, to move the control valve from a first position in which the second SSTT valve is in communication with the control lines, to a second position in which the second SSTT valve is out of communication with the control lines. This may serve to isolate the second SSTT valve from the control lines when the lines are sheared. In the second position, the control valve may place first and second ends of the SSTT valve cylinder in fluid communication, to permit movement of the piston to operate the second SSTT valve. The SSTT valve, in particular the piston, may be biased in a direction which urges fluid from one of the first and second ends of the cylinder to the other one of the first and second ends. The piston may be biased in a direction which moves the valve member to its closed position. Movement of the control valve to its second position may cause the second SSTT valve to close.

When the control valve of the second SSTT is in its second position, fluid may flow from a first end of the second SSTT valve cylinder, through the control valve to the second end of the cylinder. The control valve of the second SSTT may comprise a flow restrictor. The control valve of the second SSTT valve may be arranged so that fluid flowing from the first end of the cylinder to the second end of the cylinder passes through the flow restrictor. This may restrict the flow of fluid into the second end of the cylinder, providing the time delay in movement of the valve of the second SSTT to its closed position over or relative to the movement of the valve of the first SSTT to its closed position.

Where an SSTT is provided which comprises first and second SSTT valves, the first and second SSTT valves may be operated in the same way as the valves of the first and second SSTTs outlined above.

The or each control valve may be hydraulically piloted, such as via a hydraulic pilot line. The or each control valve may be piloted towards its first position. The or each control valve may be biased towards its respective second position. This may ensure that the valves are returned to their second positions in the event that the pilot line is sheared. Shearing of the pilot line may occur, for example, on operation of BOP shear rams. The or each control valve may be mechanically biased by a biasing spring or the like. The accumulator hydraulic line may also provide the pilot line.

According to a second aspect of the present invention, there is provided a method of controlling a well, the method comprising the steps of: locating a subsea test tree (SSTT) assembly in a well below shear rams of a blow-out preventer (BOP), the SSTT assembly comprising at least one subsea test tree (SSTT), the SSTT comprising a valve having at least one of a cutting function and a sealing function, the valve being movable between an open position and a closed position; coupling control lines to the SSTT; supplying hydraulic fluid to the valve through the control lines, to control normal operation of the SSTT valve to move between its open and closed positions; and on detecting a requirement to shut down the well: operating the BOP shear rams to close a bore of the BOP, operation of the BOP shear rams severing the SSTT control lines; and arranging a control system of the SSTT assembly so that, when the control lines are severed, hydraulic fluid is supplied from a source of hydraulic fluid of the SSTT assembly to the valve of the at least one SSTT, to automatically move the SSTT valve to the closed position and thereby close a bore of the SSTT.

The method may be a method of performing an emergency quick disconnect (EQD). Operation of the BOP shear rams may sever an item that has been deployed into the well through the BOP bore, which may be selected from the group comprising: tubing; wireline; slickline; downhole tools and/or other equipment for performing a function in the well. Where the SSTT valve has a cutting function, operation of the valve may sever a part of the item remaining within the SSTT assembly following operation of the BOP shear rams. Where the SSTT valve has a sealing function, operation of the valve may seal the SSTT bore. Optionally, the SSTT valve has both a cutting and a sealing function.

Reference is made to the SSTT assembly being located below the BOP shear rams. It will be understood that this does not necessarily require that the SSTT assembly be located vertically below the shear rams. However, the SSTT assembly will usually be located further from the surface than the shear rams, and the term should be interpreted accordingly.

Reference is made to normal operation of the SSTT valve. It will be understood that such should be taken to mean any operation of the SSTT valve involving opening or closing of the valve (or maintaining the valve in such positions) that is carried out prior to a situation arising which requires operation of the BOP shear rams, thereby severing of the control lines.

Further features of the method of the second aspect of the invention may be derived from the text set out elsewhere in this document, particularly in or with reference to the SSTT assembly of the first aspect of the invention.

Reference is made herein to an SSTT assembly, comprising an SSTT. It will be understood, however, that the principles of the present invention may apply to other types of valves/valve assemblies that are employed in the industry. Therefore in another aspect of the present invention, there is provided a valve assembly comprising a valve having at least one of a cutting function and a sealing function, the valve being movable between an open position and a closed position via hydraulic fluid supplied to the valve through control lines; and a control system comprising a source of hydraulic fluid, the control system being arranged to supply hydraulic fluid from the source of hydraulic fluid to the valve on detecting that the control lines have been sheared, to automatically move the valve to the closed position. An associated method of controlling a well employing such a valve assembly is also disclosed.

BRIEF DESCRIPTION OF THE DRAWINGS

An embodiment of the present invention will now be described, by way of example only, with reference to the accompanying drawings, in which.

DETAILED DESCRIPTION OF THE INVENTION

Figure 1:
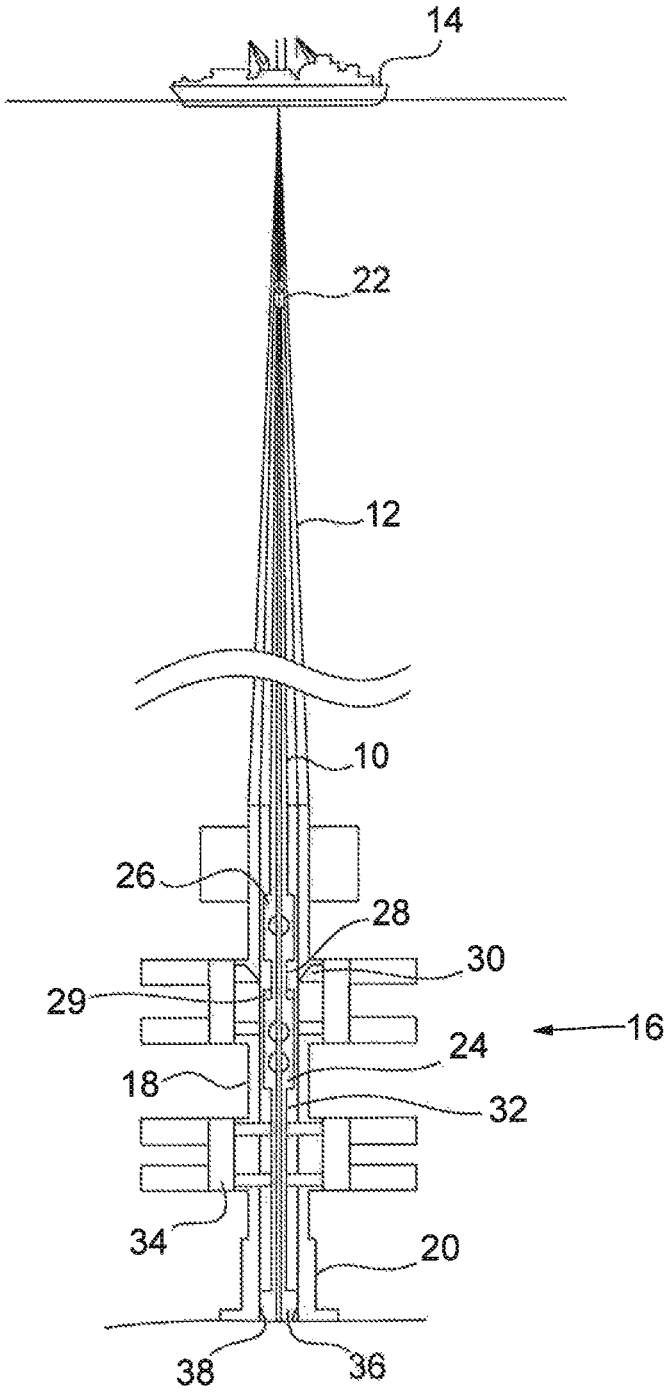
FIG. 1 is a schematic side view of a landing string of a conventional type, incorporating a subsea test tree (SSTT)

Turning firstly to FIG. 1, there is shown a schematic view of a landing string assembly 10 of a conventional type, shown in use within a riser 12 and extending between a surface vessel 14 and a subsea wellhead assembly 16, which includes a BOP 18 mounted on a wellhead 20. The use and functionality of landing strings are well known in the industry for through-riser deployment of equipment, such as completion architecture, well testing equipment, intervention tools and the like, into a subsea well from a surface vessel.

When in a deployed configuration the landing string 10 extends through the riser 12 and into the BOP 18. While deployed the landing string 10 provides many functions, including permitting the safe deployment of wireline or coiled tubing equipment (not shown) through the landing string and into the well, providing the necessary primary well control barriers and permitting emergency disconnect while isolating both the well and landing string 10. Wireline or coiled tubing deployment may be facilitated via a lubricator valve 22 which is located proximate the surface vessel 14.

Well control and isolation in the event of an emergency disconnect is provided by a suite of valves, which are located at a lower end of the landing string 10 inside the BOP. The valve suite includes a lower valve assembly in the form of a subsea test tree (SSTT) 24 which provides a safety barrier to contain well pressure, and also functions to cut any wireline or coiled tubing which extends through the landing string 10. The valve suite can also include an upper valve assembly, typically referred to as a retainer valve 26, which isolates the landing string contents and which can be used to vent trapped pressure from between the retainer valve 26 and SSTT 24. A shear sub component 28 extends between the retainer valve 26 and SSTT 24, which is capable of being sheared by shear rams 30 of the BOP 18 if required. A latch 29 connects the landing string 10 to the SSTT 24 at the shear sub 28. A slick joint 32 extends below the SSTT 24 which facilitates engagement with BOP pipe (seal) rams 34.

The landing string 10 includes a tubing hanger 36 at its lowermost end, which engages with a corresponding tubing hanger 38 provided in the wellhead 20. When the landing string 10 is fully deployed and the corresponding tubing hangers 36 and 38 are engaged, the weight of the lower string (such as a completion, workover string or the like which extends into the well and thus is not illustrated) becomes supported through the wellhead 20.

Figure 2:
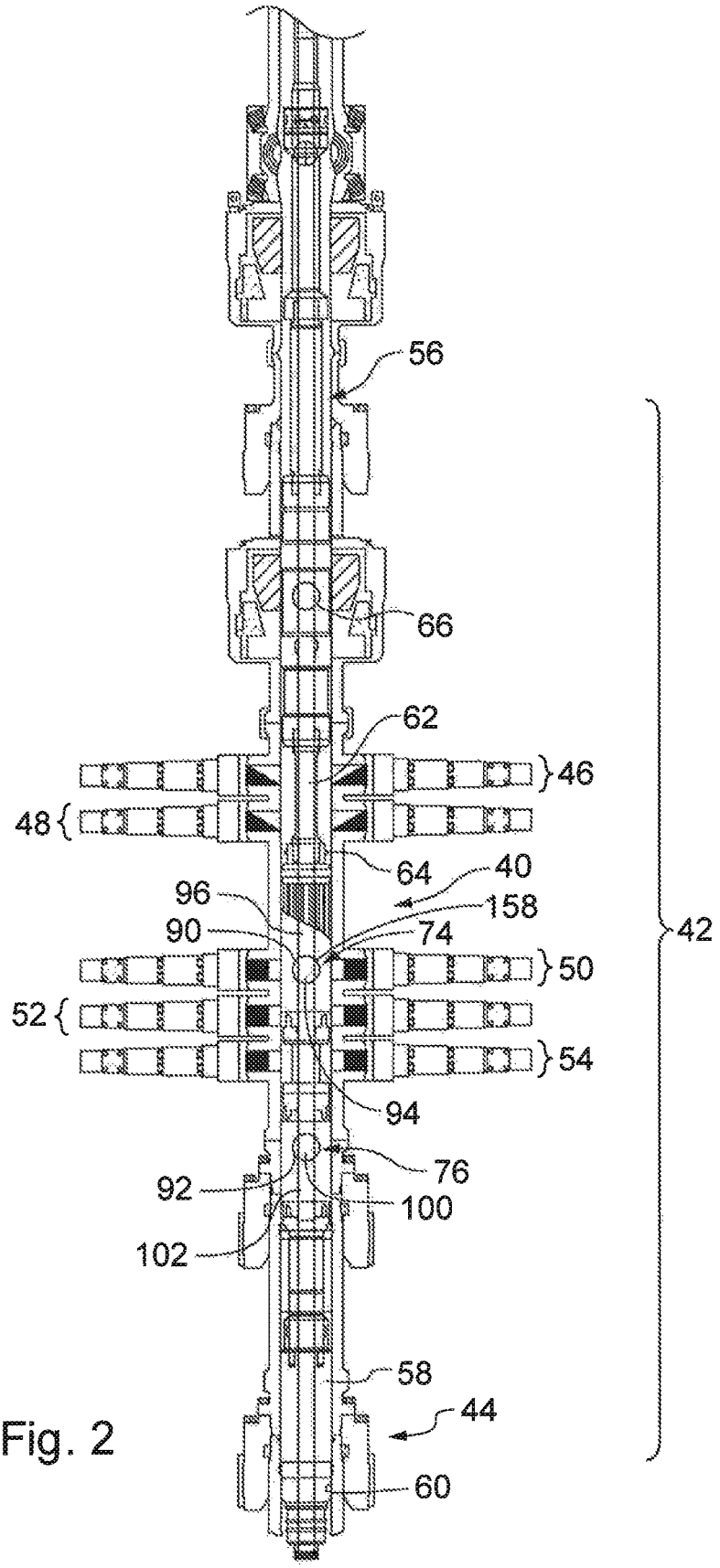
FIG. 2 is a schematic side view of a subsea test tree assembly in accordance with an embodiment of the present invention, shown during an intervention procedure, in which the assembly is located in a blowout preventer (BOP) mounted on a wellhead, the BOP being shown in a deactivated state.

Turning now to FIG. 2, there is shown a schematic side view of a subsea test tree (SSTT) assembly in accordance with an embodiment of the present invention, the assembly indicated generally by reference numeral 40. The SSTT assembly 40 is shown during an intervention procedure, in which it is located in a BOP 42 that is mounted on a wellhead 44. The BOP 42 is shown in FIG. 2 in a deactivated state, during normal intervention procedures. A typical intervention procedure may involve running a downhole tool or other component through the BOP 42 and into the well on coiled tubing, wireline or slickline (not shown), as is well known in the field of the invention. The BOP 42 shown in the drawing includes two sets of shear rams 46 and 48, and three sets of pipe (seal) rams 50, 52 and 54.

In common with the prior assembly 10 shown in FIG. 1, the SSTT assembly 40 is run into the BOP on a string of tubing, which will typically be a landing string 56, and is suspended in the wellhead 44 by an arrangement of tubing hangers 58 and 60. The SSTT assembly 40 is releasably connected to a shear sub 62 of the landing string 56 via a latch 64. The latch can be deactivated to release the string 56 for recovery to surface, say in the event of an EQD procedure being carried out. A retainer valve 66 is provided uphole of the shear sub 62.

Figure 3:
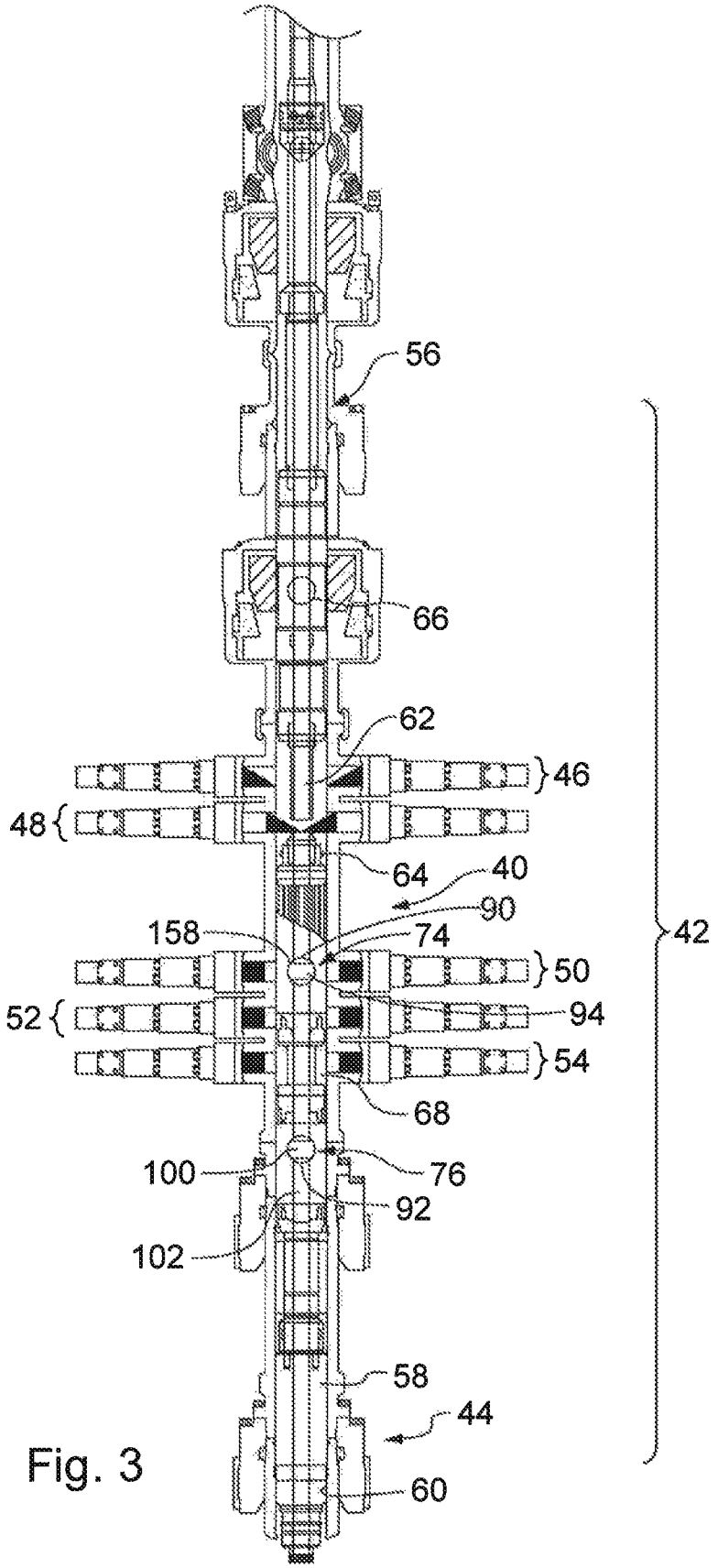
FIG. 3 is a view of the subsea test tree assembly which is similar to FIG. 2, but showing the BOP in an activated state.

In the event of an emergency situation arising which requires an EQD to be carried out, the BOP shear rams 46 and/or 48 can be operated to sever the shear sub 62. This is shown in FIG. 3, which is a view similar to FIG. 2, but which shows the BOP 42 following operation of the lower shear rams 48. The seal rams 50 to 54 will normally also be activated, sealing an annulus 68 between an external surface of the SSTT assembly 40 and an internal wall of the BOP 42. The well has then been shut down and the severed landing string 56 can be recovered to surface.

As explained in detail above, problems can occur in conventional SSTT assemblies of the type shown in FIG. 1, in the event that control lines are severed by the BOP shear rams. In particular, shearing of the control lines may prevent subsequent operation of the SSTT assembly, which can be a significant problem if the BOP 42 has been unable to effectively shutdown flow from the well. The SSTT assembly 40 of the present invention addresses these problems, as it can still be actuated to a closed state following shearing of control lines.

Figure 4:
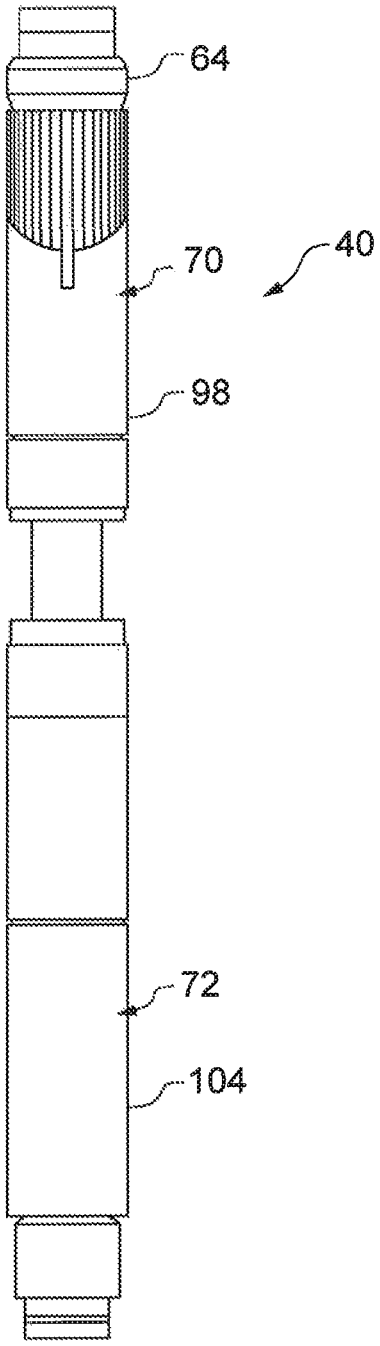
FIG. 4 is an enlarged view of the subsea test tree assembly shown in FIGS. 2 and 3.

The SSTT assembly 40 of the present invention will now be described in more detail, with reference also to FIG. 4, which is an enlarged view of the assembly shown in FIGS. 2 and 3. The SSTT assembly 40 generally comprises at least one subsea test tree (SSTT) and in the illustrated embodiment, comprises a first SSTT in the form of an upper SSTT 70, and a second SSTT in the form of a lower SSTT 72. The upper and lower SSTTs 70 and 72 each comprise a valve, which are shown in FIGS. 2 and 3 and indicated respectively by reference numerals 74 and 76, and which have at least one of a cutting function and a sealing function. In the illustrated embodiment, the valve 74 of the upper SSTT 70 has a cutting function, whilst the valve 76 of the lower SSTT 72 has a sealing function.

In a variation on the illustrated embodiment, one or both of the SSTT valves 74 and 76 can have both a cutting and a sealing function. A suitable valve is disclosed in the applicant's International patent application no. PCT/GB2015/053855 (WO-2016/113525), the disclosure of which is incorporated herein by this reference. The use of a valve having both a cutting and a sealing function may enable the provision of an SSTT assembly comprising a single SSTT, since the SSTT would be then able to perform both the cutting of tubing, wireline, slickline or other equipment extending through the SSTT bore, and the subsequent sealing of the bore. It may be preferred, however, to provide separate SSTTs, as in the assembly 40, as this provides a degree of redundancy in the system.

The SSTT valves 74 and 76 are each moveable between an open position, which is shown in FIG. 2, and a closed position, which is shown in FIG. 3. Movement of the SSTT valves 74 and 76 between their open and closed positions is controlled via hydraulic fluid supplied to the valves through control lines. This is illustrated in highly schematic form in the FIG. 5, where control lines 78 and 80 are shown, and which are associated with the upper SSTT valve 74. Separate control lines 82 and 84 are also shown, and which are associated with the lower SSTT valve 76.

The SSTT assembly 40 also comprises a control system, indicated generally by reference numeral 86, the control system comprising a source of hydraulic fluid 88. The control system 86 is arranged to supply hydraulic fluid from the fluid source 88 to the upper SSTT valve 74 on detecting that the control lines 78 and 80 associated with the upper SSTT 70 have been sheared. In this way, the control system 86 is operable to automatically move the upper SSTT valve 74 to the closed position shown in FIG. 3. The control system 86 therefore provides the ability to actuate the upper SSTT valve 70, even after the control lines 78 and 80 have been sheared by the BOP shear rams 48, which isolates the SSTT assembly 40 from a source of hydraulic control fluid (typically provided at surface on the vessel 14).

The SSTT valves 74 and 76 can be of any suitable type, but are typically ball-type valves, comprising respective ball members 90 and 92, which are rotatable between open and closed positions. In the open position of the upper valve ball member 90, a bore 94 of the ball member is aligned with a bore 96 of a housing 98 of the upper SSTT 70, whilst in a closed position, the bore 94 is disposed transverse to the housing bore 96, thereby closing the valve. The lower SSTT ball member 92 similarly comprises a bore 100 which, in the open position, is aligned with a bore 102 of a housing 104 of the lower SSTT 72, and in the closed position is transverse to the housing bore 102, thereby sealing the bore.

The control system 86 is also arranged to move the lower SSTT valve 76 to its closed position on detecting that the control lines 82 and 84 associated with the lower SSTT 72 have been sheared, so that the lower valve is similarly automatically moved to the closed position when the control lines are sheared. Typically, the control system 86 is arranged to move the lower SSTT valve 76 to its closed position with a time delay relative to the movement of the upper SSTT valve 74. The time delay is provided because the upper SSTT valve 74 has a cutting function, operating to sever tubing, wireline, slickline, or other equipment located within the valve bore 94 and the housing bore 96. Providing a time delay in the actuation of the lower SSTT valve 76 to move to its closed position therefore enables the upper SSTT valve 74 to cut the tubing or the like, which will typically fall through the bore 100 of the lower SSTT valve 76 (to a location further down the wellbore from surface) prior to it being closed. In other words, the tubing or the like is cut and dropped into the well by the upper SSTT valve 74, before the lower sealing valve 76 is operated. This ensures that the bore 100 of the lower valve 76 is not blocked by the tubing or the like, which would prevent it from moving to its closed position and so sealing the bore 102 of the lower SSTT housing 104, and thus the SSTT assembly 40.

As mentioned above, actuation of the upper SSTT valve 74 following shearing of the control lines 78 and 80 to move to its closed position is achieved using hydraulic fluid supplied from the hydraulic fluid source 88. In contrast, the lower SSTT valve 76 is actuated to move to its closed position mechanically, as will be described in more detail below. The hydraulic fluid source 88 takes the form of a hydraulic accumulator, which enables hydraulic energy to be stored for subsequent actuation of the upper SSTT valve 74, in the event that the control lines 78 and 80 are sheared. The accumulator 88 comprises a cylinder 89 defining a hydraulic fluid storage chamber 106, and an accumulation fluid storage chamber 108, which is isolated from the hydraulic fluid chamber 106 by a piston 110. The accumulator 88 is charged with hydraulic fluid from surface, via a hydraulic pilot or trigger line 112, which is typically referred to as a "pigtail". As will be described below, shearing of the pilot line 112 (when BOP shear rams are closed) acts to trigger the assembly, and so to cause the SSTT valves 74 and 76 to be moved to their closed positions. Hydraulic fluid supplied into the chamber 106 imparts a fluid pressure force on the piston 110, which translates within the cylinder 89 to compress the accumulation fluid in the chamber 108. Typically, the accumulation fluid will be a gas such as Nitrogen or Helium, the compression of which will store hydraulic energy. A one-way valve 114 is provided in the hydraulic line 112, to prevent return flow of fluid from the accumulator along the line 112, following shearing of the hydraulic line by the BOP shear rams 48. A choke 115 is provided in parallel to the valve 114, which provides a bypass line in the event that the valve becomes stuck in a closed position.

The control system 86 comprises a first control valve 116 for controlling the flow of hydraulic fluid to the upper SSTT valve 74. The control valve 116 takes the form of a shuttle valve, and is coupled to the hydraulic control lines 78 and 80 so that hydraulic fluid can be supplied from surface to control the operation of the upper SSTT valve 74, and so the upper SSTT 70. As is well known in the field of valve technology, and in particular ball-type valve technology, the valve 74 comprises a piston 118 which is moveable within a cylinder 120 under applied fluid pressure to translate a ball cage (not shown) coupled to the ball member 90, to move the ball member between its open and closed positions. These components are shown in highly schematic form in FIG. 5. Fluid is supplied to a first chamber 122 at a first end 124 of the cylinder 120 via the control line 78, and exhausted from a second chamber 126 at a second end 128 of the cylinder 120 via the control line 80, in order to move the ball member 90 to the open position shown in FIG. 2. Conversely, when it is desired to move the ball member 90 to the closed position shown in FIG. 3, fluid is supplied to the second chamber 126 via the control line 80, and exhausted from the first chamber 122 via the control line 78.

Figure 5:
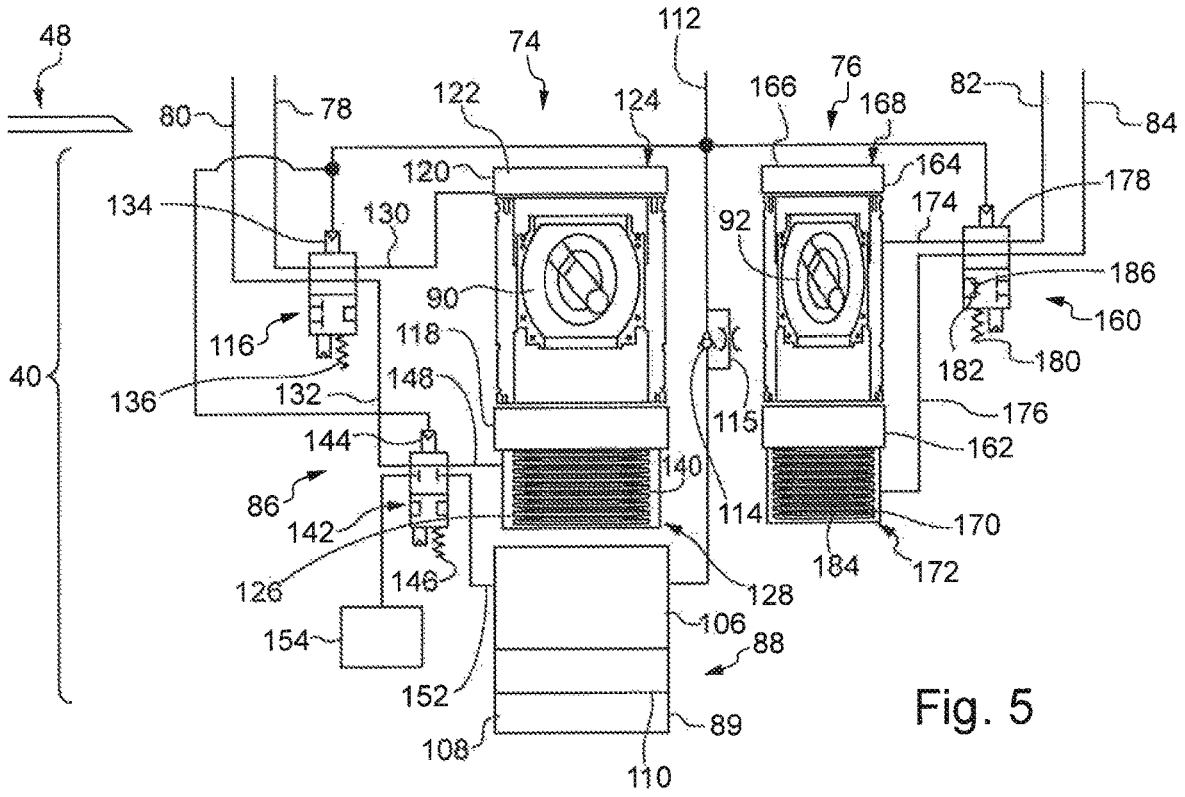
FIG. 5 is a highly schematic drawing showing parts of the SSTT assembly, illustrating features of a control system of the assembly, and showing the assembly during normal use in an intervention procedure.

The supply of hydraulic fluid to the cylinder 120, and the exhaustion of fluid from the cylinder, is controlled by the control valve 116. The control valve 116 is shown in FIG. 5 in a first position, in which a hydraulic line 130 coupling the first chamber 120 to the control valve 116 is in communication with the control line 78, and a hydraulic line 132 coupling the second chamber 126 to the control valve 116 is in communication with the control line 80. This represents a normal operating state of the SSTT assembly 40 during an intervention procedure, prior to an EQD being carried out, in which the BOP shear rams 48 are actuated.

Figure 6:
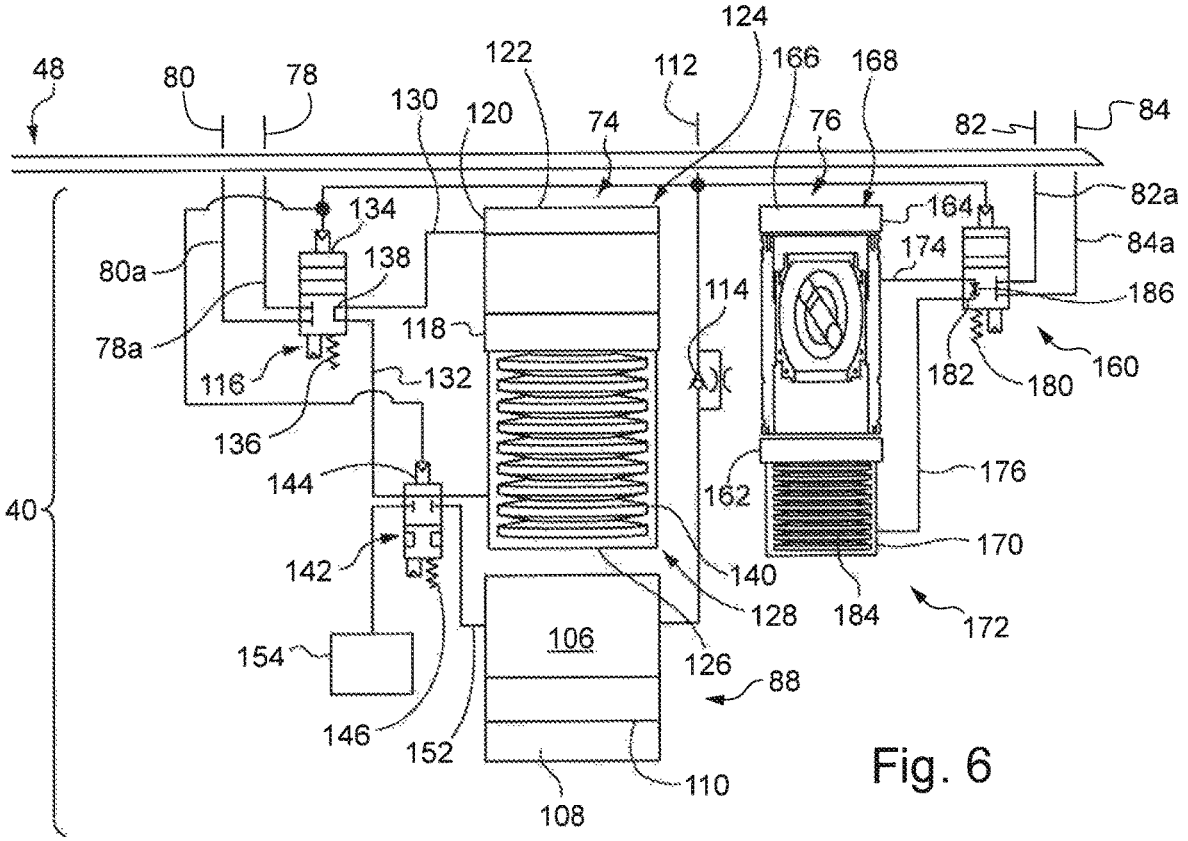
FIGS. 6 to 8 are views similar to FIG. 5, but illustrating steps in the operation of the SSTT assembly during an EQD, in which shear rams of a BOP have been operated to sever control lines connected to the SSTT assembly.

Turning now to FIG. 6, this shows the SSTT assembly 40 following actuation of the BOP shear rams 48 in an EQD procedure. As can be seen, the shear rams 48 have sheared the control lines 78 and 80, cutting off communication between the hydraulic fluid source at surface and the upper SSTT valve 74. The shear rams 48 have also sheared the hydraulic line 112, which supplies hydraulic fluid to the accumulator 88. The hydraulic line 112 also provides a hydraulic pilot function for the first control valve 116, supplying hydraulic fluid to a pilot port 134. This urges the shuttle valve 116 to the first position shown in FIG. 5, against the biasing force of a spring 136. When the hydraulic line 112 providing the pilot fluid is severed (shutting off the pilot supply through port 134), the spring 136 acts to urge the control valve 116 to the second position shown in FIG. 6. This serves a number of purposes.

Firstly, the upper SSTT valve 74 is isolated from sheared portions 78*a* and 80*a* of the control lines 78 and 80, to isolate the valve from fluid in the wellbore which could otherwise hold the ball member 90 in the open position. Secondly, the first valve chamber 122 is placed in communication with the second valve chamber 126, via a communication path 138 in the valve 116, which connects the hydraulic lines 130 and 132. A biasing member in the form of a spring 140 acting on the piston 118 translates the piston within the cylinder 120, to thereby move the ball member 90 (via its ball cage) to the closed position of FIG. 3. This serves to exhaust hydraulic fluid from the first chamber 122 into the second chamber 126, via the hydraulic line 130, communication path 138, and hydraulic line 132.

Where an EQD procedure has been carried out, tubing, wireline, slickline, or other equipment resides in the upper SSTT valve bore 94, as discussed above. The biasing spring 140 acts to urge the ball member 90 into contact with the tubing or the like. However, the spring 140 does not have sufficient spring force to sever the tubing or the like. This is facilitated by further features of the control system 86. Specifically, the control system 86 comprises a second control valve 142, also in the form of a shuttle valve, and which is associated with the accumulator 88. The second control valve 142 is arranged to control the flow of fluid from the hydraulic fluid storage chamber 106 of the accumulator 88 to the upper SSTT valve 74 in the event that the control lines 78 and 80 are sheared, as shown in FIG. 6.

In a first position of the second control valve 142 shown in both FIGS. 5 and 6, the upper SSTT valve 74 is isolated from the accumulator 88, and in fluid communication with the first control valve 116. The second control valve 142 is piloted to this position by hydraulic fluid supplied from the hydraulic line 112 to a pilot port 144 of the valve. This enables fluid communication between the second chamber 126 of the valve cylinder 120 and the hydraulic line 80, through the first control valve 116, as shown in FIG. 5. It also enables fluid communication between the first and second cylinder chambers 122 and 126 following actuation of the BOP shear rams 48, as shown in FIG. 6.

Figure 7:
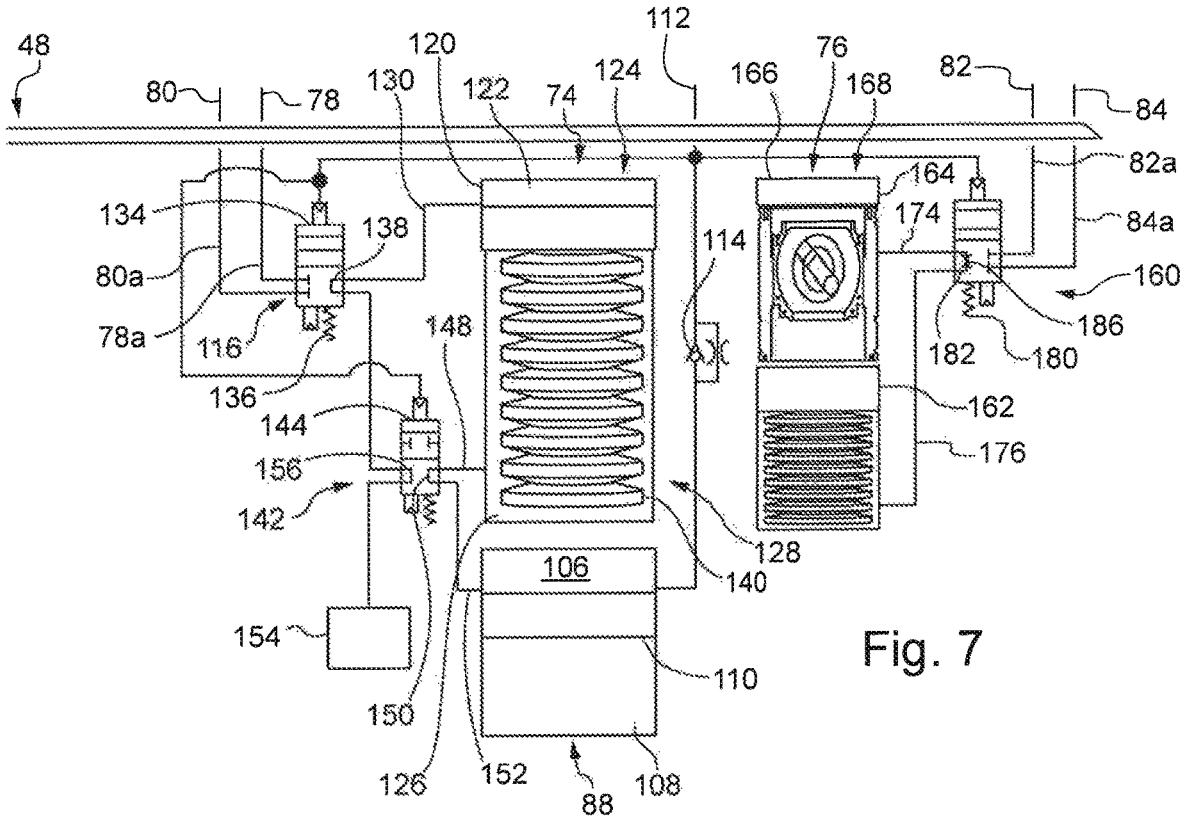

When the hydraulic line 112 is severed (shutting off the pilot supply through port 144), a spring 146 of the second control valve 142 acts to move the valve to a second position, which is shown in FIG. 7. Movement of the second control valve 142 to the second position is effected with a time delay, in order to allow movement of the upper SSTT ball member 90 to the position shown in FIG. 6, where it closes on the tubing or other component in the bore 94 of the ball member. Effectively, the second control valve 142 is held in its first position for a determined period of time, in which fluid communication between the first and second cylinder chambers 122 and 126 is maintained. The timer function may be effected by suitable logic programmed into a processor (not shown) of the control system 86, which may for example control a solenoid that maintains the valve 142 in the first position of FIG. 6 following loss of pilot pressure.

As mentioned above, FIG. 7 shows the second control valve 142 following movement to its second position. In this position, the first cylinder chamber 122 is isolated from the second chamber 126, and fluid communication between the second chamber of the cylinder and the hydraulic fluid storage chamber 106 of the accumulator 88 is opened via a hydraulic line 148, a communication path 150 in the second control valve 142, and a hydraulic line 152. This enables hydraulic fluid to be supplied from the accumulator chamber 106 into the second cylinder chamber 126. The hydraulic fluid is driven from the accumulator chamber 106 by the piston 110, which is in turn driven by the energy stored in the accumulator fluid storage chamber 108, as the gas in the chamber 108 expands.

Simultaneously, communication between the first cylinder chamber 122 and a vent chamber 154 is opened, via a communication path 156 in the second control valve 142. The vent chamber 154 contains a fluid (suitably a gas such as Nitrogen or Helium) at a lower pressure than the fluid in the cylinder 120, so that the fluid in the first cylinder chamber 122 can be vented to the vent chamber. The hydraulic fluid supplied from the accumulator storage chamber 106 into the second cylinder chamber 126 acts on the piston 118, which further rotates the ball member 90, driving it to its fully closed position. A cutting edge or surface 158 (FIG. 2) on the ball member 90 then acts to sever the tubing, wireline, slickline or other equipment located in the bore 94 of the ball member. Effectively, the stored hydraulic energy in the accumulator 88 provides sufficient motive power to drive the ball member 90 to its fully closed position. Hydraulic fluid vented from the first cylinder chamber 122 is directed through the first and second control valves 116 and 142 to the vent chamber 154.

The control system 86 also serves for controlling the flow of hydraulic fluid to the valve 76 of the lower SSTT 72. To this end, the control system 86 comprises a separate control valve 160 associated with the lower SSTT valve 76. This forms a third control valve of the system 86, which is again a shuttle valve. The third control valve 160 is coupled to the control lines 82 and 84, which are separate from the control lines 78 and 80 associated with the first upper SSTT 70. In a similar fashion to the upper SSTT valve 74, the lower SSTT valve 76 comprises a piston 162 mounted for movement within a cylinder 164, for moving a ball cage (not shown) coupled to the ball member 92, to rotate the ball member between its open and closed positions. Fluid is supplied to a first chamber 166 at a first end 168 of the cylinder 164, and exhausted from a second chamber 170 at a second end 172, in order to move the ball member 92 to its open position, and vice versa. The third control valve 160 controls fluid communication between the control line 82 and the first chamber 166 via a hydraulic line 174, and communication between the control line 84 and the second chamber 170 via a hydraulic line 176. The third control valve 160 is piloted open by fluid supplied through the hydraulic line 112 to a pilot port 178 of the valve, which acts against the biasing force of a spring 180.

The second control valve 160 is shown in a first position in FIG. 5, during normal operation of the SSTT assembly 40, in an invention procedure. In this position, the ball member 92 is in the open position shown in FIG. 2. Operation of the BOP shear rams 48 shears the control lines 82 and 84, as shown in FIG. 6. As described above, this also shears the hydraulic line 112, resulting in a loss of pilot pressure to the valve pilot port 178. This causes the third control valve 160 to move to a second position, which is shown in FIG. 6. In this position, fluid communication between the first cylinder chamber 166 and the second cylinder chamber 170 is opened, via a communication path 182 in the third control valve 160. A biasing member in the form of a spring 184 acting on the piston 162 then translates the piston within the cylinder 164, moving the ball member 92 to the closed position of FIG. 3, via its ball cage. This movement of the piston 162 exhausts fluid from the first chamber 166 into the second chamber 172, via the communication path 182. In a similar fashion to the first control valve 116, the third control valve 160 isolates the cylinder chambers 166 and 170 from sheared portions 82*a* and 84*a* of the control lines 82 and 84, following movement to its second position.

The control system 86, in particular the third control valve 160, is arranged to move the lower SSTT valve 76 to its closed position with a time delay relative to movement of the upper SSTT valve 74 to its closed position. This provides the advantage that the tubing, wireline, slickline or other equipment extending through the SSTT assembly 40 can be severed by the upper SSTT valve 74 prior to actuation of the lower SSTT valve 76. This prevents the bore 100 of the lower SSTT valve ball member 92 being blocked by the severed tubing, which would otherwise prevent the ball member 92 from moving to its closed position and so sealing the lower SSTT 72 (and thus the SSTT assembly 40). The time delay enables the cut tubing to fall through the bore 100 of the lower SSTT valve ball member 92 prior to it being actuated to move to the closed position.

The time delay in actuation of the lower SSTT valve 76 is achieved using a flow restrictor 186 in the communication path 182. In practical terms, this restricts the flow of hydraulic fluid from the first chamber 166 of the valve cylinder 164 to the second chamber 170, slowing movement of the piston 162 and thus rotation of the ball member 92 to its closed position, as shown in FIG. 7.

Figure 8:
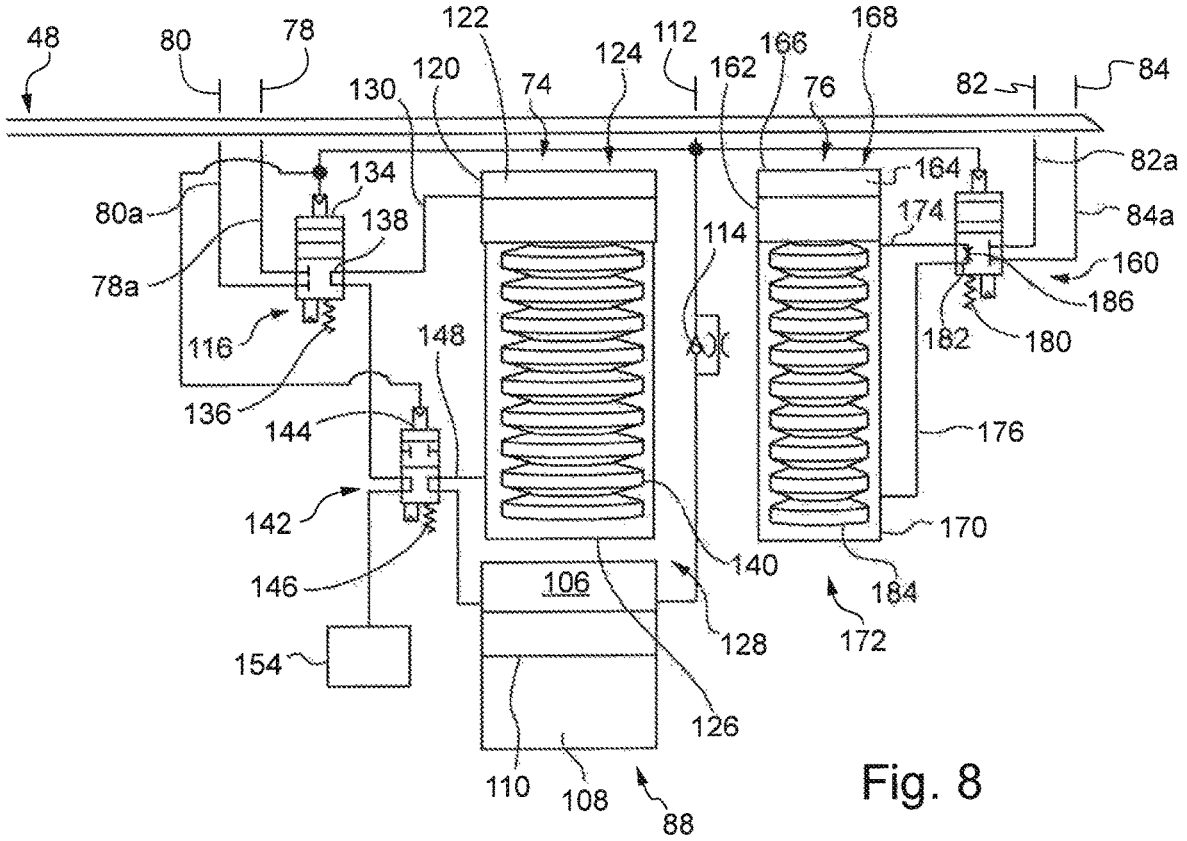

FIG. 8 shows the SSTT assembly 40 following movement of the SSTT valve 76 to its fully closed position. Both valves 74 and 76 are now fully closed. The tubing, wireline, slickline or other equipment has therefore been severed by the upper SSTT valve 74 and dropped into the wellbore, and the SSTT assembly 40 sealed by the lower SSTT valve 76. This seals a bore extending through the SSTT assembly 40, providing appropriate pressure control.

The emergency situation requiring performance of an EQD may be one of many different situations. Typically however, the shutdown will be triggered by a loss of pressure control, as may occur during an uncontrolled flow of formation fluids into the wellbore. Following operation of the SSTT assembly 40, steps can be taken to bring the wellbore back under control, for example by circulating fluids out of the wellbore through valves on the BOP 42, reducing the pressure of fluid in the wellbore below the BOP. This may also involve circulating kill fluid into the wellbore with sufficient density to overcome production of formation fluids. The BOP rams 46 to 54 can then be opened and the SSTT assembly 40 retrieved, so that the severed portion of the shear sub 62 can be released and a fresh shear sub attached. The SSTT assembly 40 can be run back into the wellbore on the landing string 56 for continuation of intervention procedures.

Figure 9:
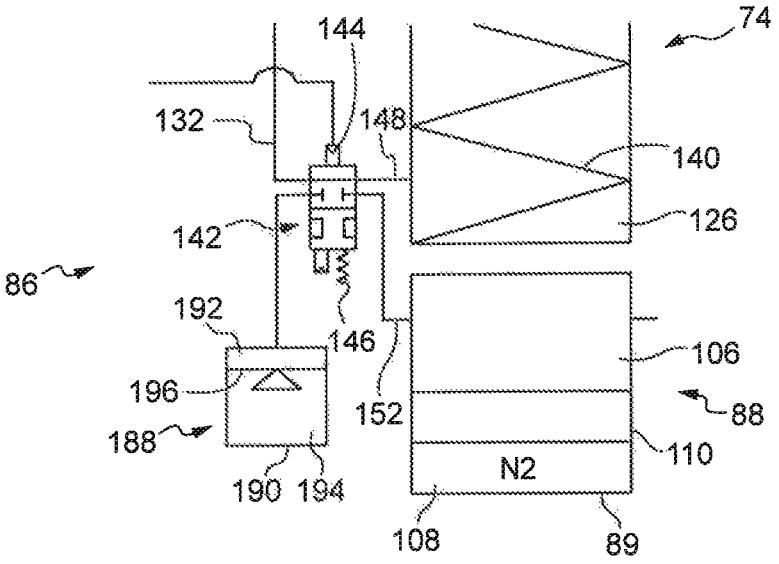
FIGS. 9 and 10 are highly schematic drawings showing part of an SSTT assembly in accordance with an alternative embodiment of the present invention, illustrating features of a control system of the assembly, showing the assembly during normal use (FIG. 9), and during an EQD (FIG. 10) in which shear rams of a BOP have been operated to sever control lines connected to the SSTT assembly.

Turning now to FIG. 9, there is shown a variation on the SSTT assembly 42 shown in FIGS. 1 to 8. The variation concerns only a part of the control system 86, and so the same reference numerals are employed for the same parts in the drawing.

Figure 10:
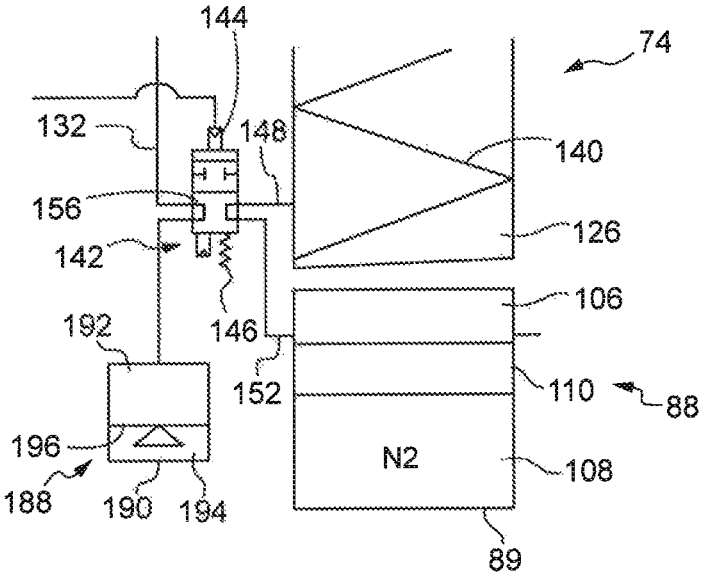

In the variation, the vent chamber 154 has been replaced with a hydraulic accumulator 188. FIG. 9 shows the control system 86 of the assembly during normal use (as in FIG. 5), and FIG. 10 shows the control system during an EQD (as in FIGS. 7 and 8), in which the shear rams 48 of the 18 BOP have been operated to sever the control lines 78, 80 and 82, 84 connected to the SSTT assembly 42.

As described above, operation of the BOP shear rams 48 severs the trigger line 112, which shuts off the pilot supply through the port 134 of the first control valve 116, and through the port 144 of the second control valve 142. Communication between the first cylinder chamber 122 of the valve 74 and the accumulator 188 has then been opened, via the communication paths 138 and 156 in the first and second control valves 116 and 142.

The accumulator 188 comprises a cylinder 190 defining a hydraulic fluid storage chamber 192, and an accumulation fluid storage chamber 194, which is isolated from the hydraulic fluid storage chamber by a piston 196. The accumulation chamber 194 contains a fluid (suitably a gas such as Nitrogen or Helium) at a lower pressure than the fluid in the cylinder 120. Fluid in the first cylinder chamber 122 which is vented to the hydraulic fluid storage chamber 192 (through the communication paths 138 and 156 in the control valves 116 and 142) translates the piston 196 within the cylinder 190, compressing the accumulation gas, as shown in FIG. 10.

This provides the advantage that a barrier exists between the accumulation gas in the chamber 194 and the hydraulic fluid in the chamber 192, which prevents the hydraulic fluid from mixing with the accumulation gas. The hydraulic fluid in the chamber 192 can then potentially be reused during a subsequent actuation of the valve 74 of the upper SSTT 70, for example to reopen the valve once pressure control has been re-achieved and the well stabilized.

Various modifications may be made to the foregoing without departing from the spirit or scope of the present invention.

For example, the valve of the at least one SSTT may be a first valve, and the SSTT may comprise at least one further valve, which may be a second valve. The control system may be arranged to move the second valve to its closed position on detecting that the control lines have been sheared, to automatically move the second valve to the closed position. The control system may be arranged to move the second valve to the closed position with a time delay over or relative to the movement of the first valve to its closed position. Where the assembly comprises a plurality of SSTTs, at least one of the SSTTs may comprise a first valve and at least one further valve.

Where there are a plurality of valves (in one or separate SSTTs), separate control lines may be provided for each valve. Where an SSTT is provided which comprises first and second SSTT valves, the first and second SSTT valves may be operated in the same way as the valves of the first and second SSTTs outlined above.

The hydraulic accumulator may comprise a diaphragm or the like separating the hydraulic fluid storage chamber from the accumulation fluid storage chamber.

At least one of the SSTTs may comprise a valve having a cutting and a sealing function. Typically, the SSTT which is to be located uppermost in the well (i.e. closer to surface) will comprise the valve having the cutting function. However, it is conceivable that the SSTT which is located lowermost in the well (i.e. further from the surface) have the cutting function, for example if operation of the SSTT assembly is effected with a delay relative to operation of BOP shear rams, the shear rams serving to sever the tubing etc. which may then fall through the SSTT assembly. The or each SSTT may comprise more than one valve, the function of a further valve or valves being selected from: a cutting function; a sealing function; and a cutting and sealing function.

Reference is made herein to an SSTT assembly, comprising an SSTT. It will be understood, however, that the principles of the present invention may apply to other types of valves/valve assemblies that are employed in the industry.

The invention claimed is:

1. A subsea test tree assembly comprising:

at least one subsea test tree (SSTT), the SSTT comprising an SSTT valve having at least one of a cutting function and a sealing function, the SSTT valve being movable between an open position and a closed position via hydraulic fluid supplied to the SSTT valve through control lines; and a control system comprising a source of hydraulic fluid, the control system being arranged to supply hydraulic fluid from the source of hydraulic fluid to the SSTT valve on detecting that the control lines have been sheared, to automatically move the SSTT valve to the closed position;

wherein the assembly comprises at least one further valve which is movable between an open position and a closed position via hydraulic fluid supplied to the further valve through control lines; and wherein the control system is arranged to move the further valve to its closed position on detecting that the control lines have been sheared, to automatically move the further valve to the closed position.

2. The assembly as claimed in claim 1, in which the control system is arranged to detect that the SSTT valve is in its open position, and to close the SSTT valve on subsequently detecting that the control lines have been sheared.

3. The assembly as claimed in claim 1, in which the control system comprises a pilot line, shearing of the pilot line triggering movement of the SSTT valve to the closed position.

4. The assembly as claimed in claim 1, in which the control system is arranged to move the further valve to the closed position with a time delay relative to the movement of the first valve to its closed position.

5. The assembly as claimed in claim 1, in which the source of hydraulic fluid is a hydraulic accumulator comprising a hydraulic fluid storage chamber, an accumulation fluid storage chamber containing an accumulation gas, and a pressurizing element separating the hydraulic fluid storage chamber from the accumulation fluid storage chamber, hydraulic energy being stored by compression of the accumulation gas.

6. The assembly as claimed in claim 1, in which the control system comprises a control valve for controlling the flow of hydraulic fluid between the control lines and the SSTT valve, and in which the SSTT valve is hydraulically operated, the SSTT valve comprising a piston which is mounted for movement within a cylinder, fluid being supplied to the cylinder by the control valve, and a valve member associated with the piston and which is movable between a closed position where it closes a bore of the SSTT and an open position in which the bore is open.

7. The assembly as claimed in claim 6, in which the control system is arranged to actuate the control valve on detecting that the control lines have been sheared, to move the control valve from a first position in which the SSTT valve is in communication with the control lines, to a second position in which the SSTT valve is out of communication with the control lines.

8. The assembly as claimed in claim 7, in which the control valve controls the flow of fluid to and from a first chamber at a first end of the cylinder, and a second chamber at a second end of the cylinder, to control movement of the piston, and in which the control valve, when in its second position, places the first and second chambers of the cylinder in fluid communication, to permit movement of the piston to operate the SSTT valve.

9. The assembly as claimed in claim 7, in which the control valve is hydraulically piloted towards its first position, and biased towards its second position.

10. The assembly as claimed in claim 6, in which the control valve is a first control valve, and the control system comprises a second control valve coupled to the source of hydraulic fluid and to the SSTT valve, the second control valve being arranged to control the flow of fluid from the hydraulic fluid source to the SSTT valve in the event that the control lines are sheared.

11. The assembly as claimed in claim 10, in which the second control valve is movable between a first position where the hydraulic fluid source is out of communication with the SSTT valve, and a second position where the hydraulic fluid source is in communication with the SSTT valve.

12. The assembly as claimed in claim 11, in which the first control valve controls the flow of fluid to and from a first chamber at a first end of the cylinder, and a second chamber at a second end of the cylinder, to control movement of the piston, and in which the control system is arranged so that, when the second control valve is in its second position, one of the first and second ends of the SSTT valve cylinder communicates with a vent chamber.

13. The assembly as claimed in claim 11, in which the control valve controls the flow of fluid to and from a first chamber at a first end of the cylinder, and a second chamber at a second end of the cylinder, to control movement of the piston, and in which the control system is arranged so that, when the second control valve is in its second position, one of the first and second ends of the SSTT valve cylinder communicates with a hydraulic accumulator.

14. The assembly as claimed in claim 10, in which the control system is arranged to actuate the first control valve on detecting that the control lines have been sheared, to move the first control valve from a first position in which the SSTT valve is in communication with the control lines, to a second position in which the SSTT valve is out of communication with the control lines, and in which the control system is arranged to operate the second control valve to move to its second position only after movement of the first control valve to its second position.

15. The assembly as claimed in claim 10, in which the first control valve controls the flow of fluid to and from a first chamber at a first end of the cylinder, and a second chamber at a second end of the cylinder, to control movement of the piston, and in which the second control valve is associated with the first control valve, fluid flowing from the first end of the SSTT valve cylinder through the first control valve to the second control valve, and through the second control valve to the second end of the cylinder.

16. The assembly as claimed in as claimed in claim 6, wherein the control system comprises a separate control valve for controlling the flow of hydraulic fluid to the further valve.

17. The assembly as claimed in claim 16, in which the separate control valve controls the flow of the fluid to and from the further valve.

18. The assembly as claimed in claim 17, in which the further valve is hydraulically operated, the further valve comprising a piston which is mounted for movement within a cylinder, fluid being supplied to the cylinder by the control valve, and a valve member associated with the piston and which is movable between a closed position where it closes a bore of the SSTT and an open position in which the bore is open.

19. The assembly as claimed in claim 16, in which the control system is arranged to actuate the separate control valve of the further valve on detecting that the control lines have been sheared, to move the separate control valve from a first position in which the further valve is in communication with the control lines, to a second position in which the further valve is out of communication with the control lines.

20. The assembly as claimed in claim 19, in which the separate control valve controls the flow of fluid to and from a first chamber at a first end of the cylinder, and a second chamber at a second end of the cylinder, to control movement of the piston, and in which the control valve, when in the second position, places the first and second ends of the SSTT valve cylinder in fluid communication, to permit movement of the piston to operate the further valve.

21. The assembly as claimed in claim 20, in which, when the separate control valve is in its second position, fluid flows from a first end of the second SSTT valve cylinder, through the separate control valve to the second end of the cylinder.

22. The assembly as claimed in claim 21, in which the separate control valve comprises a flow restrictor, fluid flowing from the first end of the cylinder to the second end of the cylinder passing through the flow restrictor, which restricts the flow of fluid into the second end of the cylinder and provides a time delay in movement of the further valve to its closed position relative to the movement of the SSTT valve to its closed position.

23. The assembly as claimed in claim 1, in which the control system comprises a vent chamber which communicates with the SSTT valve so that it receives hydraulic fluid from the SSTT valve when it is moved to its closed position.

24. The assembly as claimed in claim 23, in which the vent chamber contains a gas at a lower pressure than the fluid in the cylinder.

25. The assembly as claimed in claim 1, in which the control system comprises a hydraulic accumulator which communicates with the SSTT valve so that it receives hydraulic fluid from the SSTT valve when the SSTT valve is moved to its closed position.

26. The assembly as claimed in claim 1, in which the SSTT valve has both a cutting and a sealing function.

27. A subsea test tree assembly comprising:

a first subsea test tree (SSTT);

a second SSTT;

wherein the first SSTT includes an SSTT valve having a cutting function, the SSTT valve being movable between an open position and a closed position via hydraulic fluid supplied to the SSTT valve through control lines; and the second SSTT comprises a further valve which is movable between an open position and a closed position via hydraulic fluid supplied to the further valve through the control lines, and the further valve has a sealing function; and a control system comprising a source of hydraulic fluid, the control system being arranged to supply hydraulic fluid from the source of hydraulic fluid to the SSTT valve on detecting that the control lines have been sheared, to automatically move the SSTT valve to the closed position.

28. The assembly as claimed in claim 27, in which the control system is arranged to move the further valve of the second SSTT to its closed position on detecting that the control lines have been sheared, to automatically move the further valve to the closed position, the control system arranged to move the further valve of the second SSTT to the closed position with a time delay relative to the movement of the SSTT valve to its closed position.

29. A method of controlling a well, the method comprising the steps of:

locating a subsea test tree (SSTT) assembly in a well below shear rams of a blow-out preventer (BOP), the SSTT assembly comprising at least one subsea test tree (SSTT), the SSTT comprising an SSTT valve having at least one of a cutting function and a sealing function, the valve being movable between an open position and a closed position, and the assembly further comprising at least one further valve which is movable between an open position and a closed position;

coupling control lines to the SSTT and the further valve;

supplying hydraulic fluid to the SSTT valve and the further valve through the control lines, to control normal operation of the SSTT valve to move between its open and closed positions, and to operate the further valve between its open and closed positions; and on detecting a requirement to shut down the well:

operating the BOP shear rams to close a bore of the BOP, operation of the BOP shear rams severing the SSTT control lines; and arranging a control system of the SSTT assembly so that, when the control lines are severed, hydraulic fluid is supplied from a source of hydraulic fluid of the SSTT assembly to the SSTT valve, to automatically move the SSTT valve to the closed position and thereby close a bore of the SSTT, and to the further valve to automatically move the further valve to its closed position.

* * * * *